US006281913B1

(12) United States Patent
Webb

(10) Patent No.: US 6,281,913 B1
(45) Date of Patent: Aug. 28, 2001

(54) OPERATION OF DROPLET DEPOSITION APPARATUS

(75) Inventor: Laura Anne Webb, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/440,450

(22) Filed: Nov. 15, 1999

Related U.S. Application Data

(63) Continuation of application No. PCT/GB98/01387, filed on May 15, 1998.

(30) Foreign Application Priority Data

May 15, 1997 (GB) ..... 9709862
Feb. 12, 1998 (GB) ..... 9802871

(51) Int. Cl.[7] ..... B41J 2/135; B41J 2/145; B41J 29/38

(52) U.S. Cl. ..... 347/46; 347/7; 347/11

(58) Field of Search ..... 347/46, 11, 7, 347/13, 15, 70, 71, 72, 14, 10, 9, 23

(56) References Cited

U.S. PATENT DOCUMENTS

| | | | |
|---|---|---|---|
| 4,513,299 | 4/1985 | Lee et al. | 346/140 R |
| 5,736,993 | 4/1998 | Regimbal et al. | 347/11 |
| 5,736,994 | 4/1998 | Takahashi | 347/11 |

FOREIGN PATENT DOCUMENTS

| | | |
|---|---|---|
| 2217833 | 4/1998 | (CA) . |
| 0 043 286 A1 | 1/1982 | (EP) . |
| 0 115 180 A2 | 8/1984 | (EP) . |
| 0 203 534 A1 | 12/1986 | (EP) . |
| 0 437 062 A2 | 7/1991 | (EP) . |
| 0 467 656 A2 | 1/1992 | (EP) . |
| 0 511 602 A1 | 11/1992 | (EP) . |
| 0 541 129 A1 | 5/1993 | (EP) . |
| 0 636 477 A2 | 2/1995 | (EP) . |
| 0 721 840 A2 | 7/1996 | (EP) . |
| 0 827 838 A2 | 3/1998 | (EP) . |
| 0 835 757 A2 | 4/1998 | (EP) . |
| 2 157 623 | 10/1985 | (GB) . |
| WO 94/26522 | 11/1994 | (WO) . |
| WO 96/10488 | 4/1996 | (WO) . |

*Primary Examiner*—John Barlow
*Assistant Examiner*—Charles W. Stewart, Jr.
(74) *Attorney, Agent, or Firm*—Marshall, O'Toole, Gerstein, Murray & Borun

(57) ABSTRACT

A method of operating an inkjet printhead for printing on a substrate, the printhead having an array of channels; a series of nozzles which communicate respectively with said channels for ejection of droplets therefrom; connection means for connecting the channels with a source of ink; and electrically actuable means associated with each channel and actuable a plurality of times in accordance with print tone data, thereby to eject a corresponding number of droplets to form a printed dot of appropriate tone on the substrate, the method comprising the steps of: applying one or a plurality of electrical signals to the electrically actuable means associated with a channel in accordance with the print tone data, the duration of each signal being chosen such that the velocity of the corresponding ejected droplet is substantially independent of (a) whether or not channels in the vicinity of said selected channel are similarly actuated to effect drop ejection simultaneously with drop ejection from said selected channel, and (b) the number of droplets to be ejected in accordance with the print tone data.

28 Claims, 13 Drawing Sheets

OPERATION OF DROPLET DEPOSITION APPARATUS

This is a continuation of International Application No. PCT/GB98/01387 filed May 15, 1998, the entire disclosure of which is incorporated herein by reference.

The present invention relates to methods of operating pulsed droplet deposition apparatus, in particular an inkjet printhead, comprising an array of parallel channels disposed side-by-side, a series of nozzles which communicate respectively with said channels for ejection of droplets therefrom; connection means for connecting the channels with a source of droplet fluid; and electrically actuable means for ejecting a droplet from a selected channel.

Such apparatus is known, for example, from W095/25011, U.S. Pat. No. 5,227,813 and EP-A-0 422 870 (all incorporated herein by reference) and in which the channels are separated one from the next by side walls which extend in the lengthwise direction of the channels and which can be displaced in response to the actuating signal. The electrically actuable means typically comprise piezoelectric material in at least some of the side walls.

The last of the aforementioned documents discloses the concept of "multipulse greyscale printing": firing a variable number of ink droplets from a single channel within a short period of time, the droplets merging (in flight and/or on the paper) to form a correspondingly variable size printed dot on the paper. FIG. 1 is taken from the aforementioned EP-A-0 422 870 and illustrates diagrammatically droplet ejection from ten neighbouring printhead channels ejecting varying numbers (64,60,55,40,etc.) of droplets. The regular spacing of successive droplets ejected from any one channel indicates that the ejection velocity of successive droplets is constant. It will also be noted that this spacing is the same for channels ejecting a high number of droplets as for channels ejecting a low number of droplets.

In the course of experiment, several deviations from the behaviour described in EP-A-0 422 870 have been discovered.

The first finding is that the first droplet to be ejected from a given channel is slowed by air resistance and may find itself hit from behind by subsequently ejected droplets travelling in its slipstream and therefore subject to less air drag. First and subsequent droplets may then merge to form a single, large drop.

The second finding is that the velocity of such a single, large drop will vary depending on the total number of droplets ejected in one go from a given channel. This is not a desirable condition: as is generally known, variation in drop velocity leads to dot placement errors.

A third finding relates to three-cycle operation of the printhead—described, for example in EP-A-0 376 532—in which successive channels in a printhead are alternately assigned to one of three groups. Each group is enabled in turn, with enabled channels ejecting one or more droplets in accordance with incoming print data as described above. It has been discovered that the velocity of the single, large drop formed by the merging of such droplets will vary depending on whether the adjacent channel in the same group is also being operated (i.e. 1 in 3 channels) or whether only the next-but-one channel in the same group is being operated (i.e. 1 in 6 channels).

These findings are illustrated in FIG. 2 which shows the velocity U of the first drop to hit the paper (which may be a single droplet or a large drop made up of several merged droplets) against the total duration T of a draw-reinforce-release (DRR) actuating waveform. Such a waveform—well known in the art—is illustrated in FIG. 3*a* and places a printhead channel initially in an expanded condition (a "draw" as at E), subsequently switches to a contracted condition (a "reinforce" as at RF) and then "releases" (as at RL) the channel back to its original condition. As shown in FIG. 3*a*, the draw and reinforce periods of the waveform used to obtain FIG. 2 are equal and have a peak-to-peak amplitude of 40V (this need not necessarily be the case, however). Each repetition of the waveform results in the ejection of one droplet and, as shown in FIG. 3*b*, the waveform may be repeated several times in immediate succession so as to eject several droplets ("droplets per dot" or "dpd") and form a correspondingly sized dot on the paper. It will be appreciated that this step is repeated for each channel every time the group to which it belongs is enabled and the incoming print data is such that it is required to print a dot. In the experiment used to obtain the data shown in FIG. 2, channels were repeatedly enabled—and dots were printed—at a frequency of 60Hz.

It will be seen that the application of a single DRR waveform of around 4.5 $\mu$s duration (to eject a single droplet i.e. 1 dpd) will result in a velocity of approximately to 12 m/s per second if only alternate channels in a group are fired (1 in 6 operation) whereas a velocity of around 14 m/s results if every channel in a group is fired (1 in 3 operation). The velocity is that measured shortly before the drop hits the paper and after any merging has taken place. However, applying the same waveform seven times in immediate succession (7 dpd) so as to eject seven droplets results in a velocity of around 37 m/s when operated "1 in 3" and a velocity of around 25 m/s when operated "1 in 6".

Such wide variations in velocity could give rise to significant dot placement errors. The present invention at least in its preferred embodiments has as an objective the avoidance of such dot placement errors when generated by the newly-discovered phenomenon described above.

Figure 1:
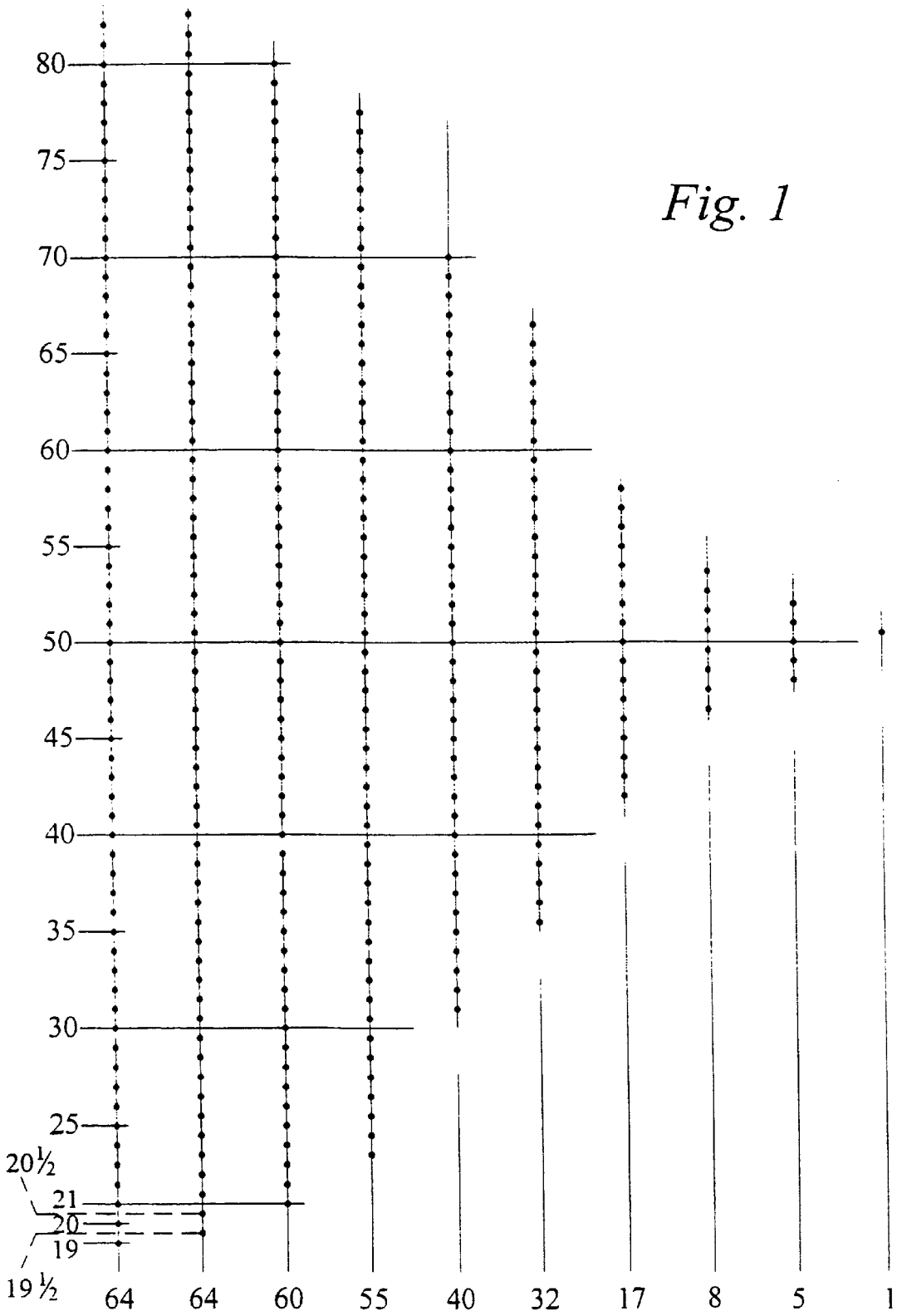
FIG. 1 is a diagram that illustrates prior art droplet ejection from ten neighboring printhead channels ejecting varying numbers of droplets.
Figure 2:
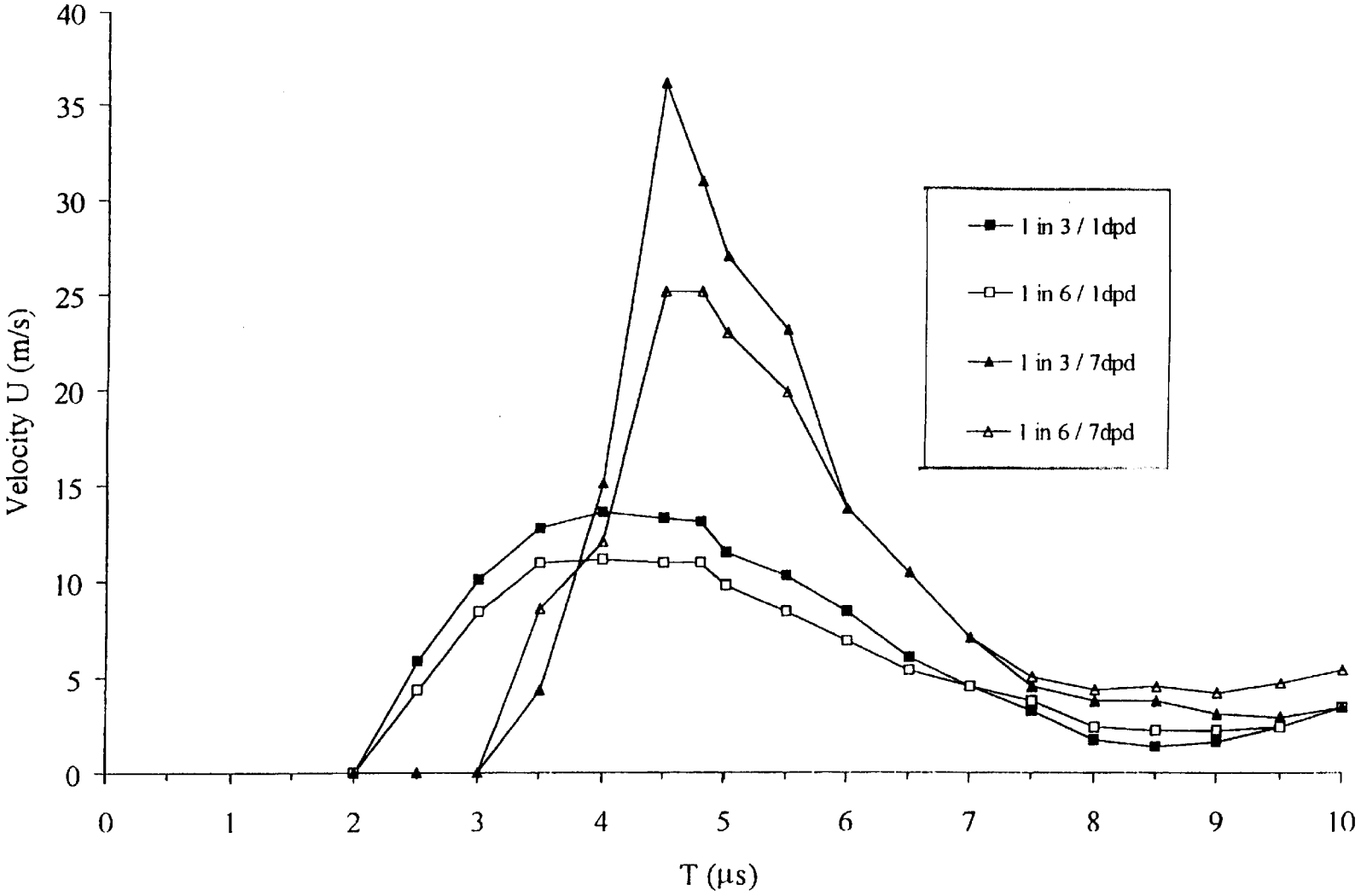
FIG. 2 is a chart plotting first drop velocity against total time duration of a draw-reinforced-release (DRR) actuating waveform.
Figure 3A:
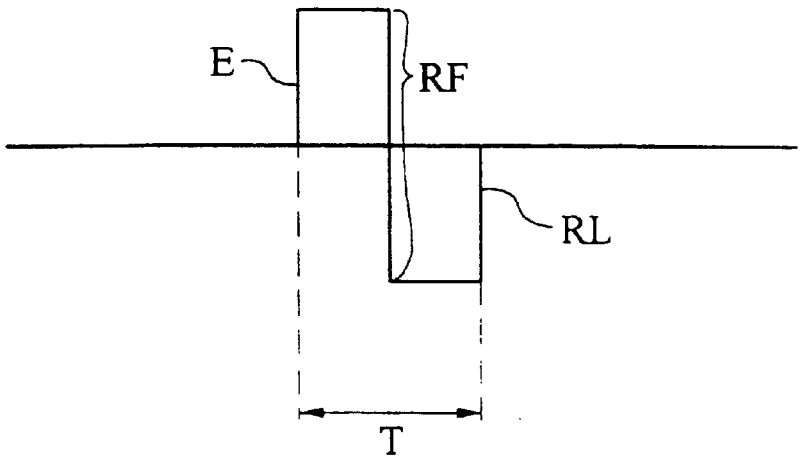

FIG. 3*a* illustrates a prior art DRR waveform as represented in FIG. 2.

Figure 3B:
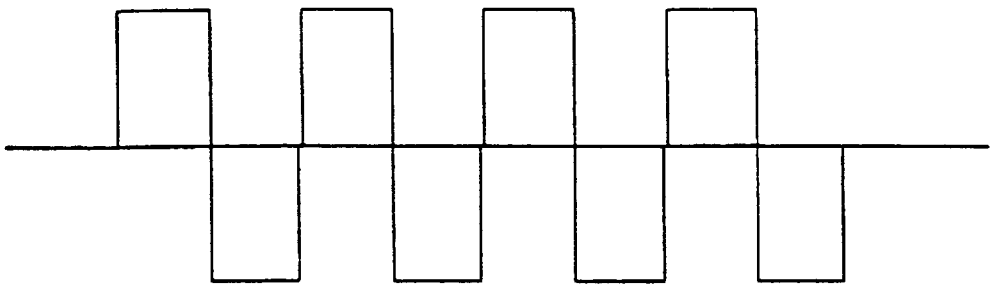

FIG. 3*b* illustrates the waveform shown in FIG. 3A repeated a number of times in immediate succession so as to eject several droplets per printed dot.

Figure 4:
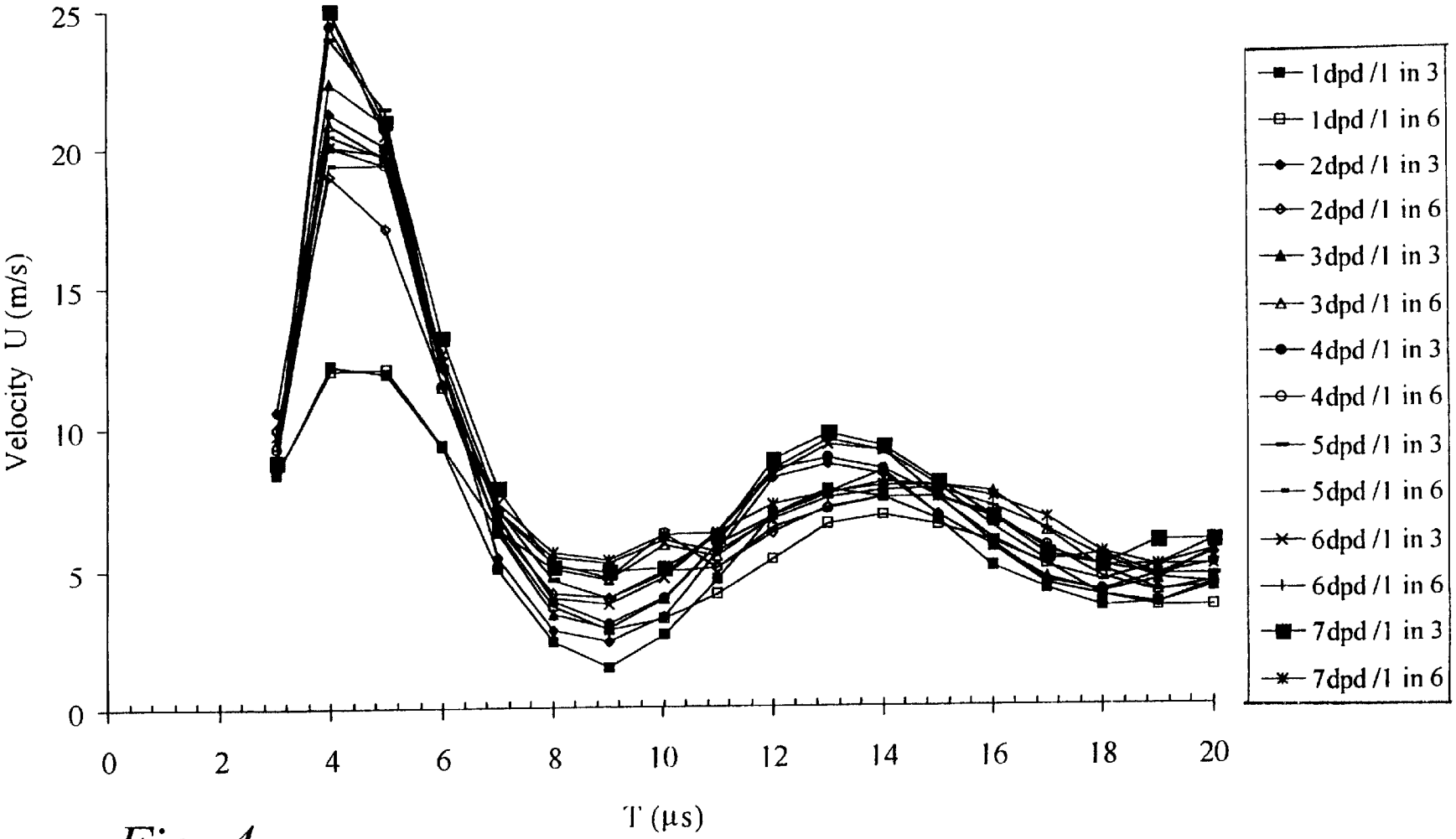

FIG. 4 is a chart of data obtained utilizing a DDR waveform shown in FIG. 3A.

Figure 5:
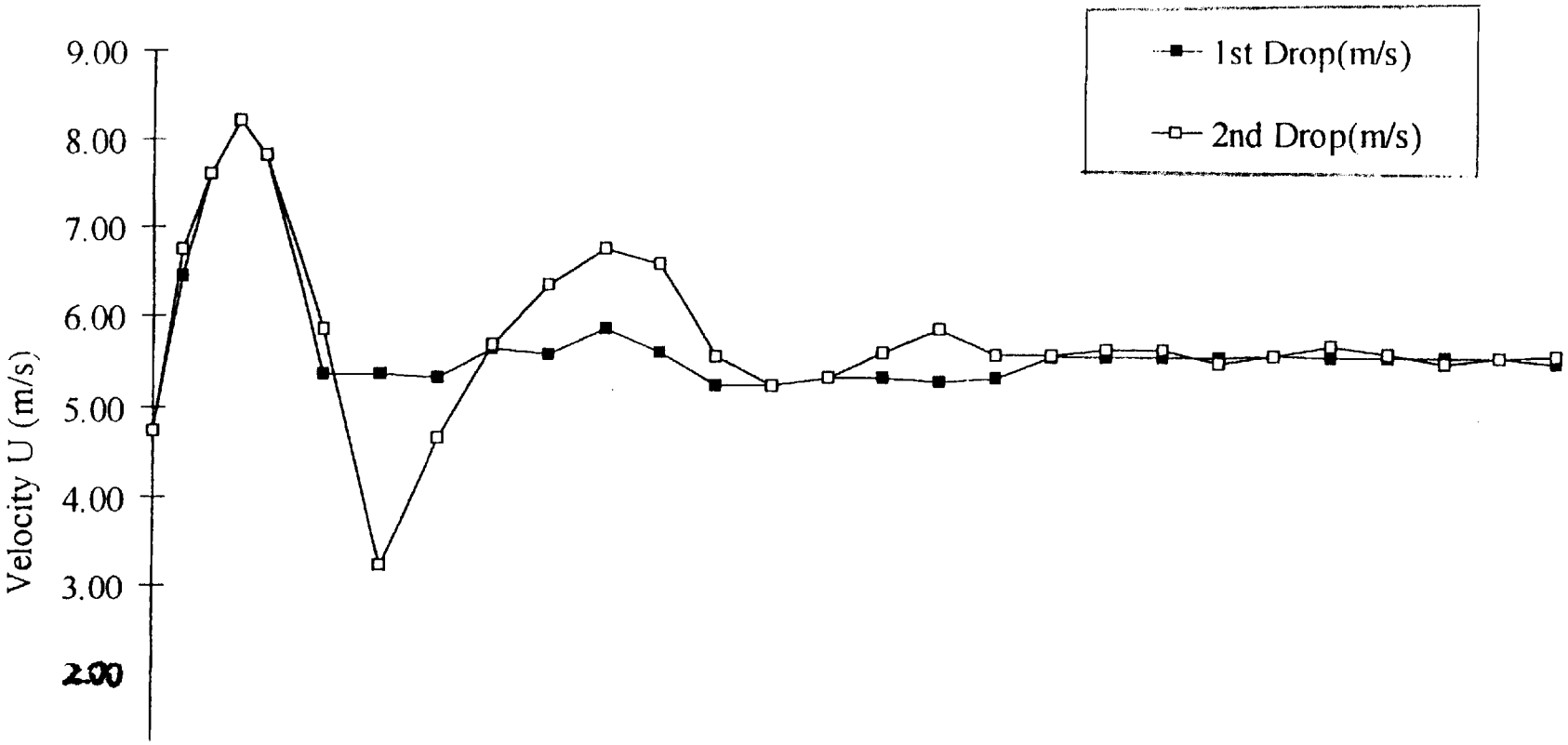

FIG. 5 is a chart plotting first and second ejected droplet velocity against total waveform duration for a printhead of the type used to obtain the data shown in FIG. 2.

Figure 6:
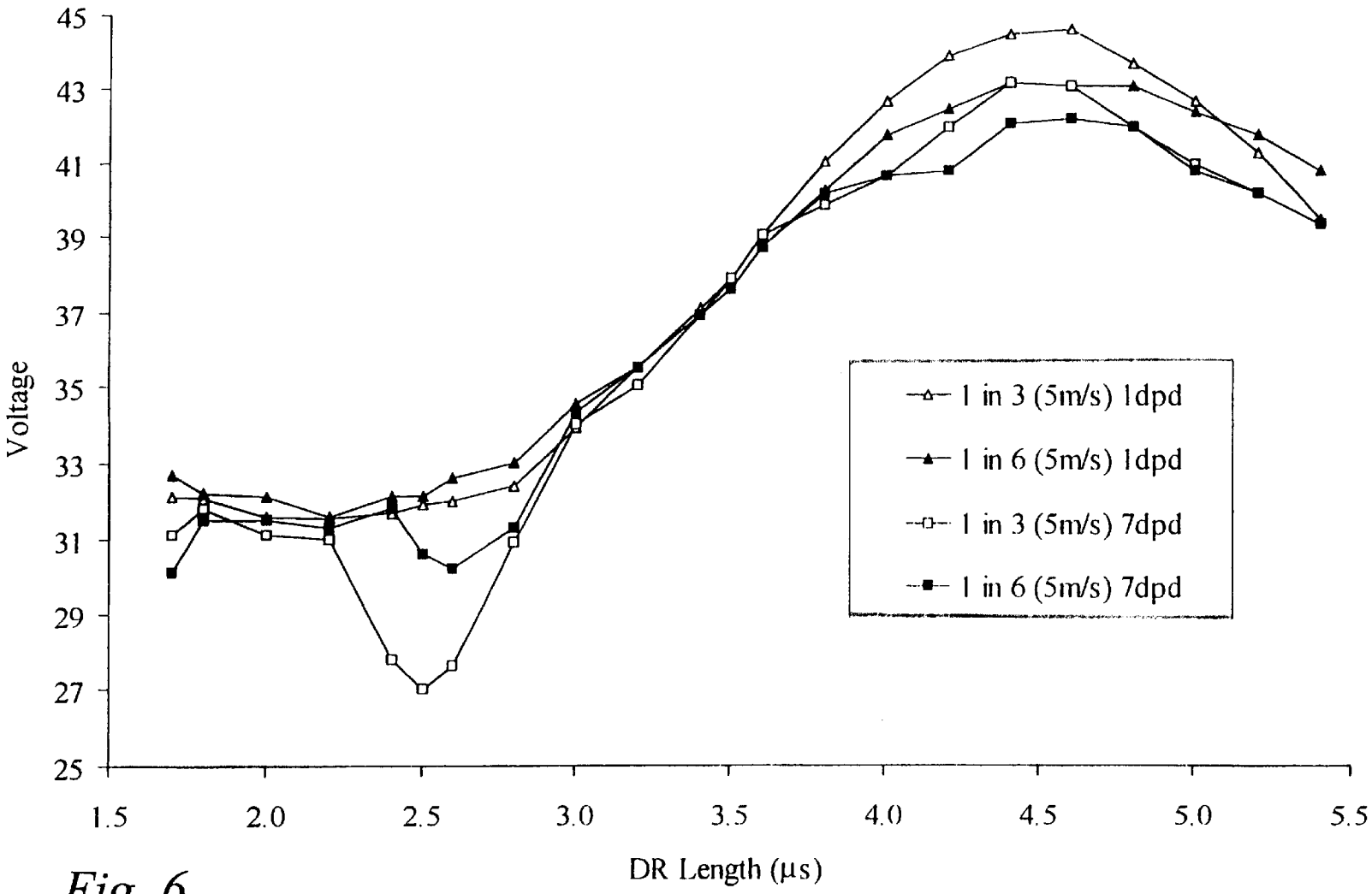

FIG. 6 is a diagram that illustrates the variation of peak-to-peak waveform amplitude or voltage against increasing contraction duration (DR) to achieve a droplet ejection velocity of 5 m/s.

Figure 7:
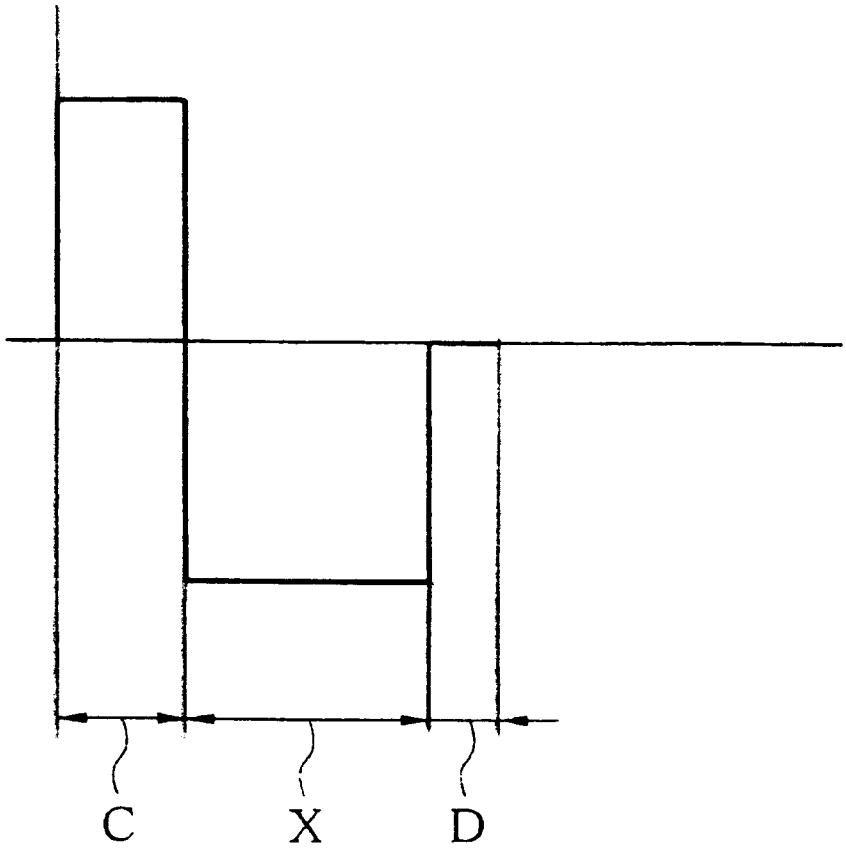

FIG. 7 illustrates an actuating waveform utilized to obtain the diagram shown in FIG. 6 with actuating voltage indicated on the ordinate and normalized time on the abscissa.

Figure 8:
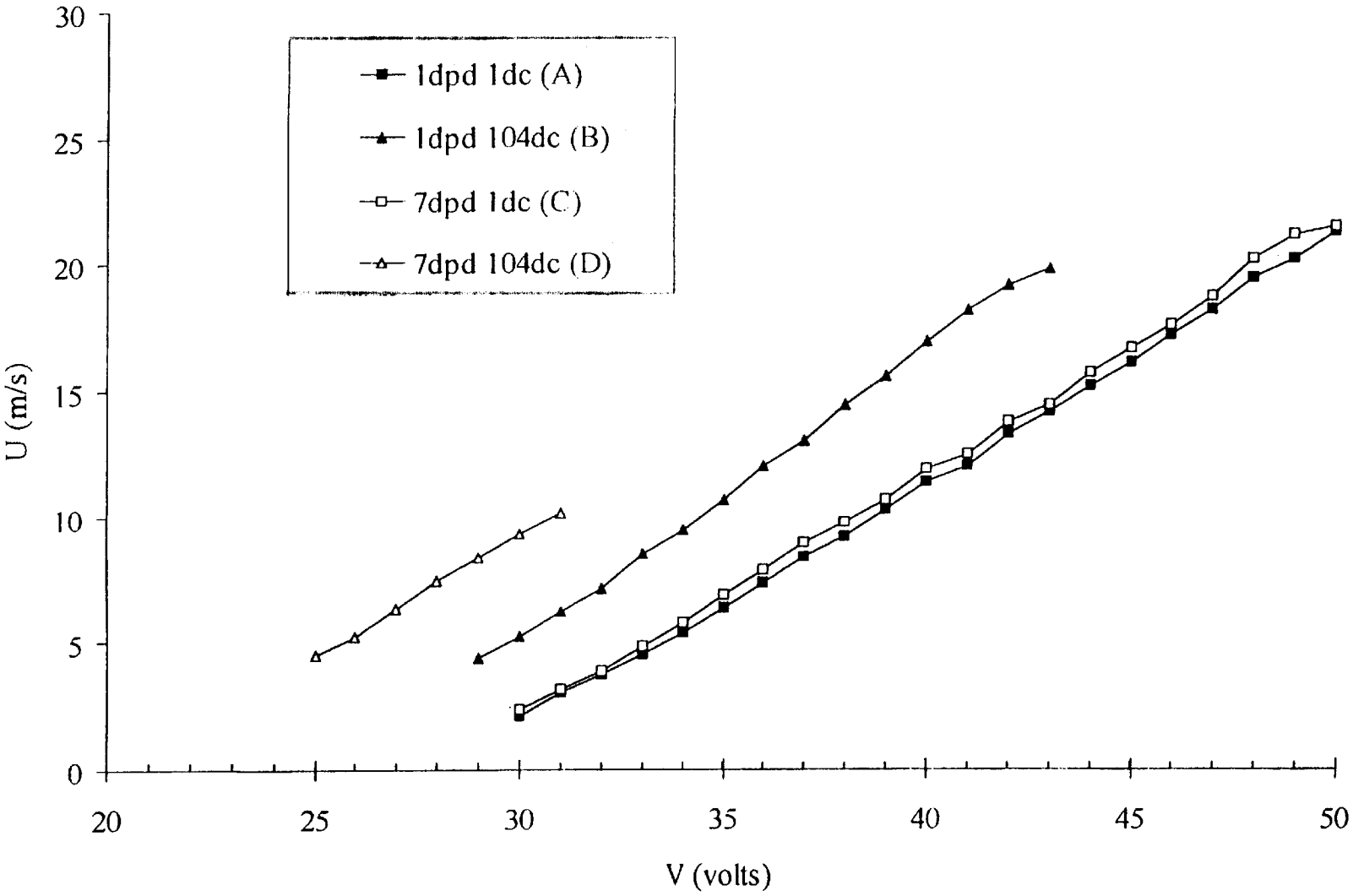

FIG. 8 is a chart plotting a variation in droplet ejection velocity against peak-to-peak amplitude or voltage for a particular droplet ejection regime.

Figure 9:
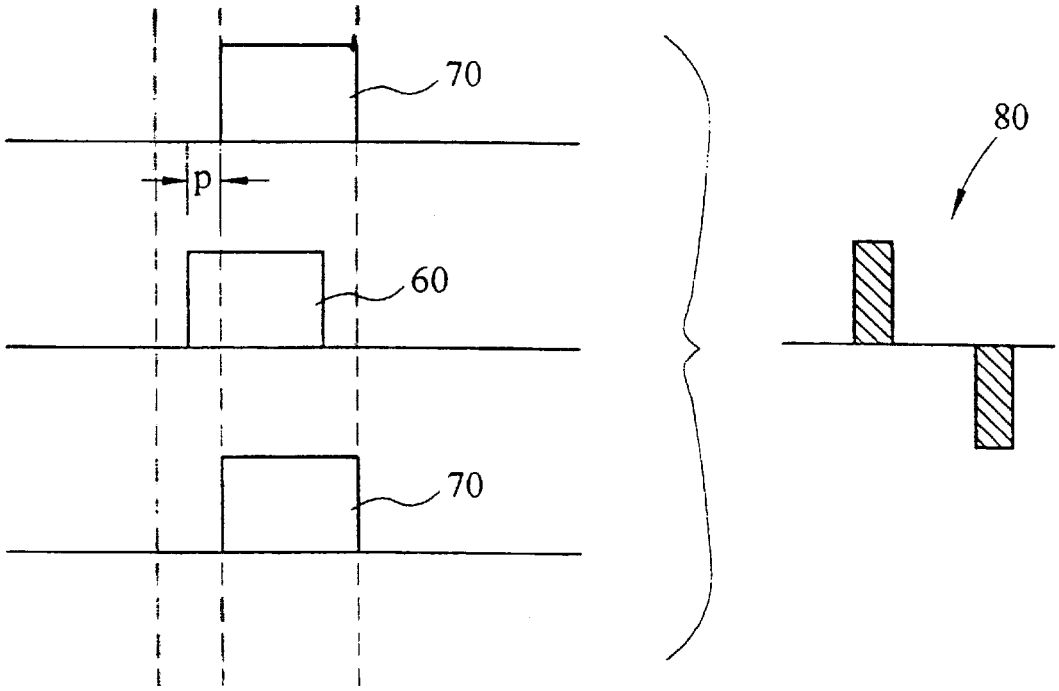

FIG. 9 illustrates a prior art non-ejecting waveform shape.

Figure 10:
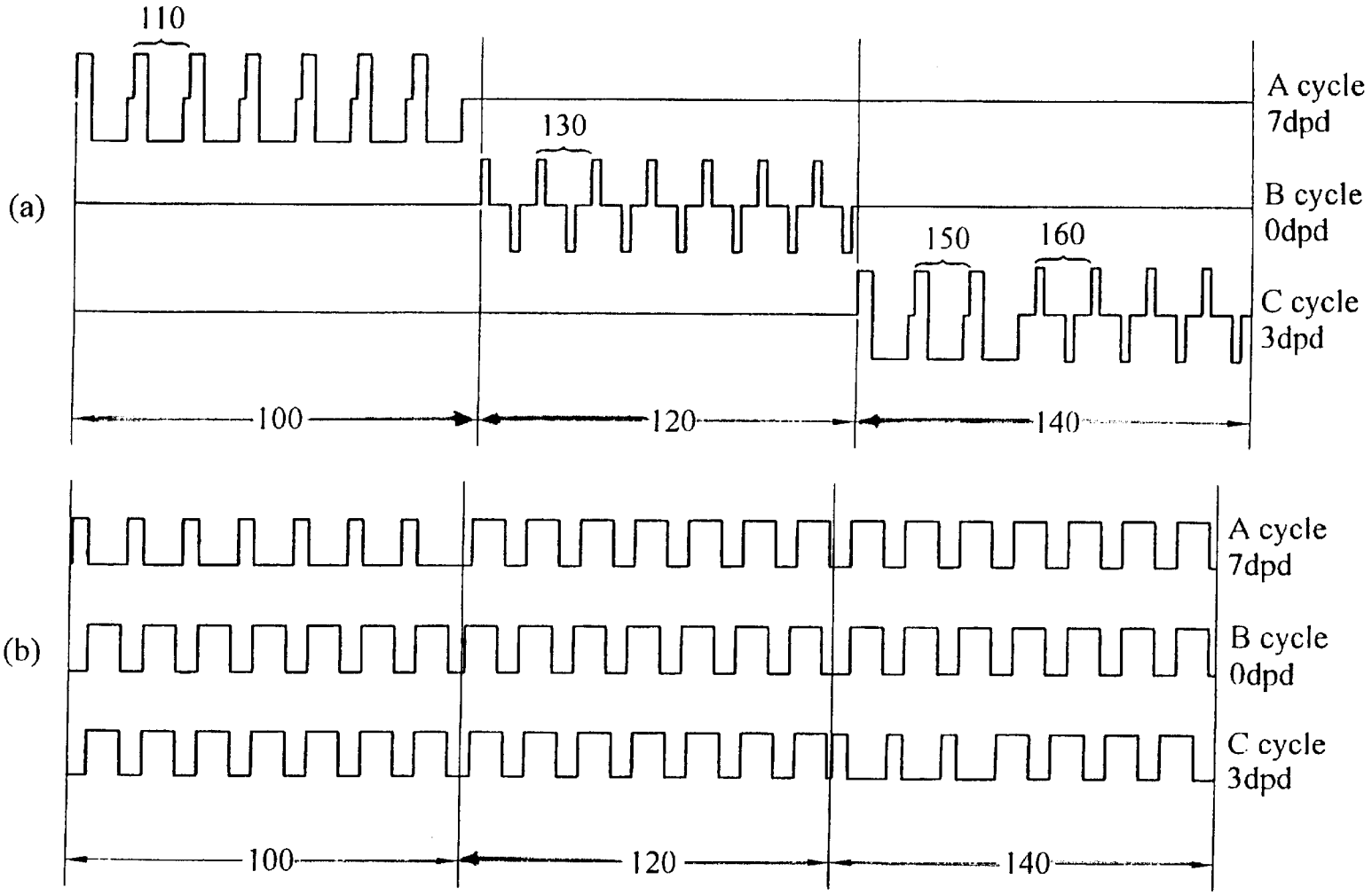

FIG. 10*a* illustrates an example of ejecting non-actuation waveforms that can be applied to three neighboring channels of three successively-enabled channel groups A, B, and C.

FIG. 10*b* illustrates a corresponding voltage waveform applied to the channel electrodes of the three neighboring channels to generate the actuating waveforms shown in FIG. 10*a*.

Figure 11:
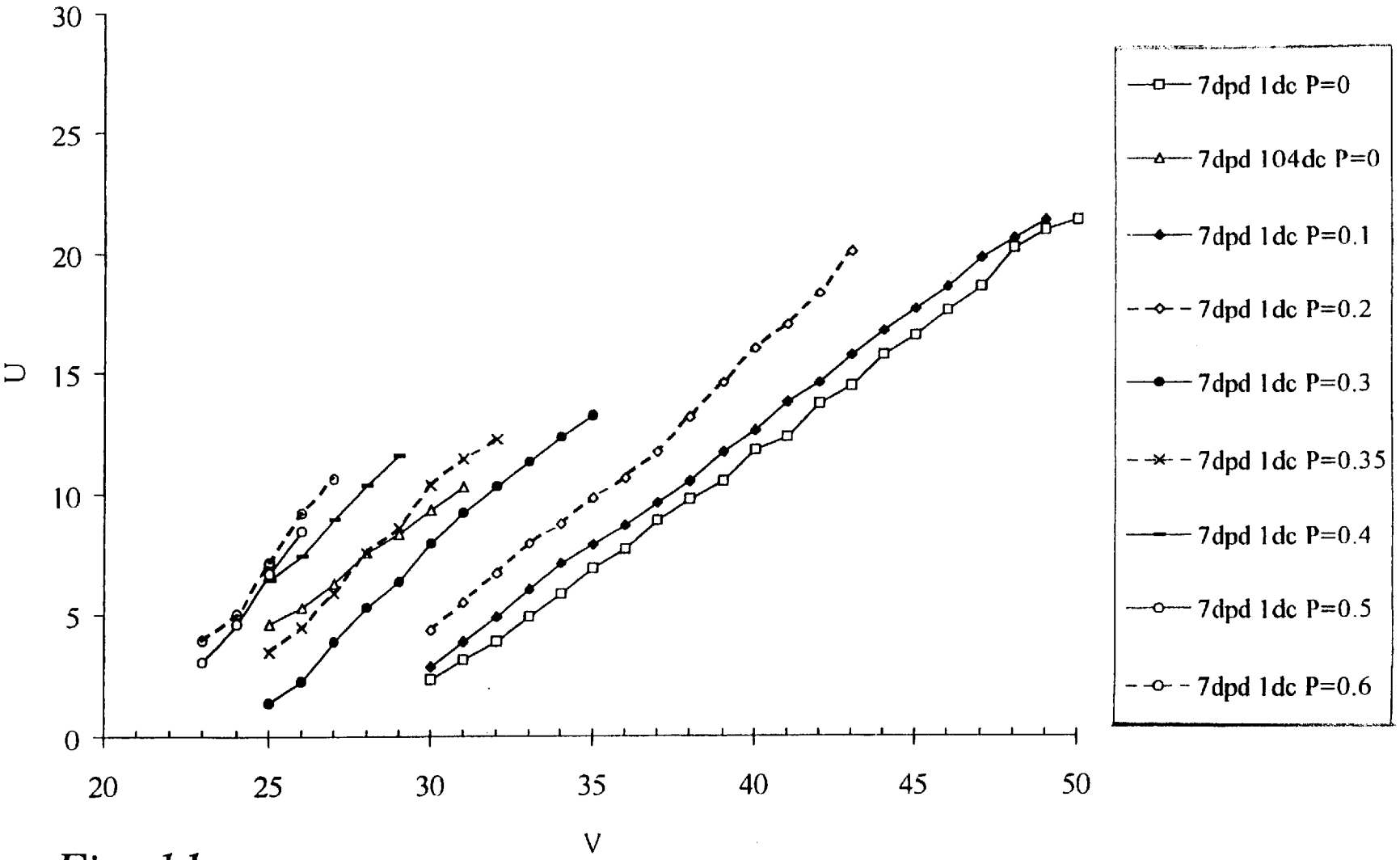

FIG. 11 is a chart plotting droplet ejection velocity against peak-to-peak amplitude or voltage and shows the effect of varying an offset "P" for the voltage pulse applied to a channel to an enabled channel group relative to a voltage pulse applied to neighboring channels belonging to non-enabled groups.

Figure 12:
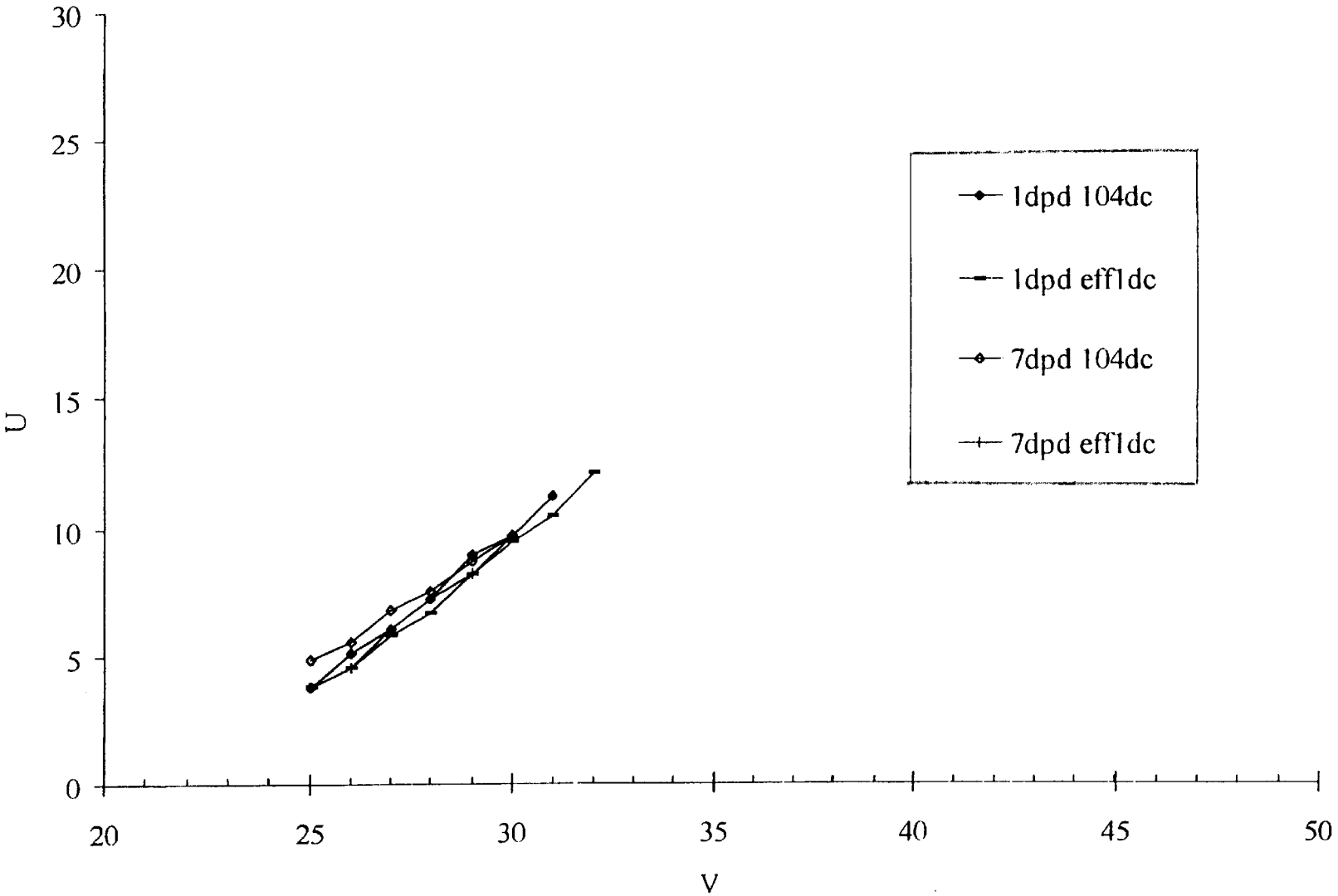

FIG. 12 is a diagram that illustrates performance of a printhead used to obtain the chart data of FIG. 8 when operated using a non-ejecting waveform having an offset P=0.35.

Figure 13:
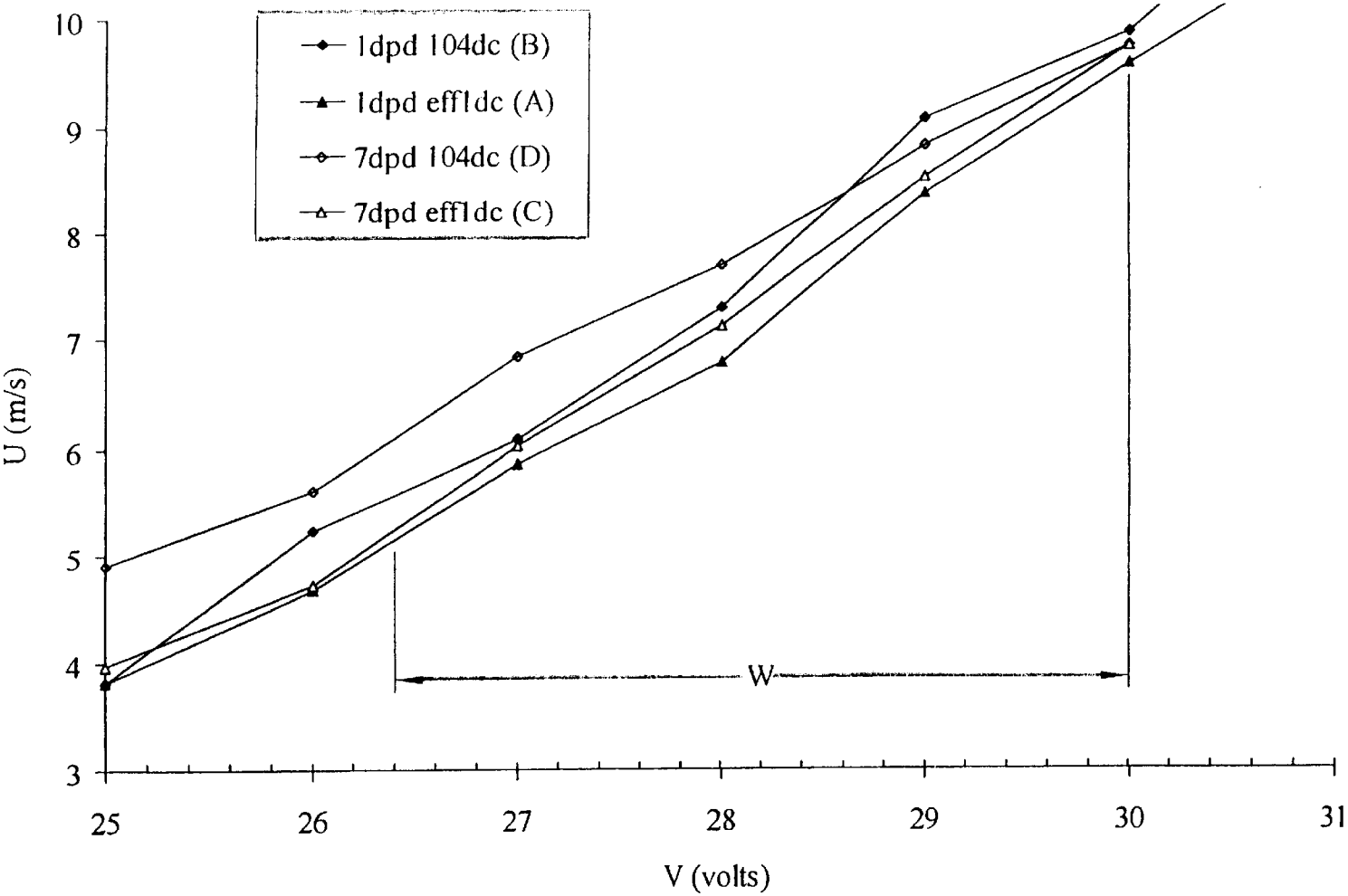

FIG. 13 illustrates an enlarged view of part of the diagram of FIG. 12 showing an operating window of approximately 3.6 volts.

Accordingly, the present invention consists in a first aspect in a method of operating an inkjet printhead for printing on a substrate, the printhead having an array of channels; a series of nozzles which communicate respectively with said channels for ejection of droplets therefrom; connection means for connecting the channels with a source of ink; and electrically actuable means associated with each channel and actuable a plurality of times in accordance with print tone data, thereby to eject a corresponding number of droplets to form a printed dot of appropriate tone on the substrate; the method comprising the steps of applying one or a plurality of electrical signals to the electrically actuable means associated with a channel in accordance with the print tone data, the duration of each signal being chosen such that the velocity of the corresponding ejected droplet is substantially independent of (a) whether or not channels in the vicinity of said selected channel are similarly actuated to effect drop ejection simultaneously with drop ejection from said selected channel, and (b) the number of droplets to be ejected in accordance with the print tone data.

Preferred embodiments of this first aspect of the invention are set out in the dependent claims and description. The invention also comprises droplet deposition apparatus and drive circuit means adapted to operate according to these claims.

Thus, in accordance with the claims, it has been discovered that there are certain advantageous values of total waveform duration T at which the aforementioned variation in velocity is much reduced. In the case of FIG. 2, it will be seen that by operating a printhead with a waveform of approx. 3.8 $\mu$s duration, the velocity remains fairly constant at around 12 m/s regardless of the number of droplets ejected in one go or the firing/non-firing status of adjacent channels in the same group. Similarly, operation with a waveform of around 7.5 $\mu$s or greater will result in a fairly constant velocity although, at only 4 m/s, this is less desirable.

FIG. 2 was obtained using a printhead of the kind disclosed in the aforementioned WO95/25011 and having a ratio (L/c) of closed channel length to velocity of pressure waves in the ink of approximately 2 $\mu$s. As is known from WO97/18952, for example, such a ratio corresponds approximately to the time taken for a pressure wave in the ink to travel the closed channel length i.e. half the period of oscillation of longitudinal pressure waves in the channel. This is reflected in the "1 in 3/1 dpd" trace which has a resonant peak at that value of T (=4 $\mu$s) at which the compression and expansion elements of the actuation waveform are each of 2 $\mu$s duration. Thus, expressed in terms of L/c, the advantageous values referred to above are 1.9 L/c and >3.75 L/c respectively.

It should be noted that at 2 $\mu$s, this duration is significantly shorter than is employed in similar printheads designed to eject a single ink droplet in any one droplet ejection period—so-called "binary" printing—in which a greater channel length L is required to achieve the necessary greater droplet volume. The corresponding reduction in maximum droplet ejection frequency is offset by the fact that only one—rather than a plurality—of drops need be ejected to form the printed dot on the substrate. In contrast, "multipulse greyscale" operation—in which a plurality of droplets form the printed dot—typically requires a printhead in which the half period of oscillation of longitudinal pressure waves in the channel has a value not exceeding 5 $\mu$s, preferably not exceeding 2.5 $\mu$s, in order that sufficiently high repetition frequencies and, secondarily, sufficiently low droplet volumes can be achieved.

Whilst the aforementioned advantageous values of waveform duration will vary with printhead design, actuation waveform and dot printing frequency, the manner in which they are determined—namely from a graph of the kind shown in FIG. 2—will remain the same. For various values of actuation waveform duration T, velocity data U is obtained either from analysis of the landing positions of ejected droplets on a substrate moving at a known speed or—preferably—by observation of droplet ejection stroboscopically under a microscope.

FIG. 4 shows data obtained for another printhead of the kind discussed in WO95/25011 with L/c again equal to 2 $\mu$s and actuation with the 40V peak-to-peak DRR waveform of FIG. 3*a*. The figure shows not only the extremes of 1 and 7 dpd operation but also the intermediate values of 2,3,4,5 and 6 dpd, each being fired with both "1 in 3" and "1 in 6" patterns.

For this arrangement, it will be seen that the advantageous values of T at which velocity variation is minimised occur at around T=3, 7, 11 and 15 $\mu$s corresponding to 1.5, 3.5, 5.5 and 7.5 L/c respectively—resulting in droplet ejection velocities, U, in the region of 9, 7, 5 and7 m/s respectively. The first of these values is to be preferred for actual printhead operation, however, since higher values of T result not only in lower droplet ejection velocities but also a greater waveform duration overall and a correspondingly lower dot printing rate. For acceptable print quality—i.e. to ensure accurate placement of printed dots on a substrate—a droplet ejection velocity of at least 5 m/s—and preferably at least 7 m/s has been found to be necessary.

FIG. 5 is a plot of the velocity (U1,U2) of first and second droplets ejected from a printhead of the kind used to obtain FIG. 2 against total waveform duration T. It is believed to offer an explanation of the behaviour shown in FIG. 2, namely that at certain values of T the velocity U2 of the second droplet to be ejected is greater than the velocity U1 of the first droplet to be ejected. The second droplet consequently hits the first droplet from the rear, the resulting larger, merged drop having a velocity greater than U1 (by conservation of momentum). This corresponds to the velocity peaks in the "1 in 3"/7 dpd and "1 in 6"/7 dpd curves of FIG. 2. In contrast, there are other values of T where U1 and U2 are substantially equal and velocity differences between single and multiple droplet ejection are minimised. The aforementioned advantageous operation points occur where these minima coincide with points of minimum velocity variation due to changes in printing pattern between "1 in 3" operation and "1 in 6" operation.

A similar increase in ejection velocity over previously ejected droplets has been noticed in the ejection of the third and subsequent droplets of a train of seven droplets. It is believed that this behaviour corresponds to a build up in the acoustic energy remaining in an ink channel at the end of each actuation waveform. It is further believed that, at the advantageous operation points mentioned above, interaction between successive waveforms is such as to cancel out this residual acoustic energy, resulting in the ejection of successive droplets at uniform velocity.

As mentioned above, the "DRR" waveform shown in FIG. 3*a* need not necessarily have channel contraction and expansion elements that are equal in duration and/or amplitude. Indeed, it is believed that the duration of the contraction element of the waveform may have more influence on the behaviour discussed above than the duration of the actuation waveform as a whole.

FIG. 6 illustrates the variation with increasing contraction period duration (DR) of the peak-to-peak waveform amplitude (V) necessary to achieve a droplet ejection velocity (U) of 5 m/s. As with FIGS. 2 and 4, the printhead was of the kind disclosed in WO95/25011 and having a period of longitudinal oscillation of pressure waves in the channel, 2 L/c, of approximately 4.4 $\mu$s. It will be seen that at values of contraction period duration (DR) of around 2.5 $\mu$s and 4.5 $\mu$s, different values of waveform amplitude V are necessary depending on the droplet firing regime.

In the case of DR=2.5 $\mu$s, a peak-to-peak waveform amplitude (V) of only 27 volts is required when applying the waveform seven times in immediate succession so as to eject seven droplets (7 drops per dot (dpd)) from one in every three channels ("1 in 3" operation) in multipulse greyscale printing mode. In contrast, a value of V=32 volts is necessary to achieve the same droplet ejection velocity when applying the waveform only once so as to eject a single droplet (1 drop per dot (dpd)) from one in every six channels ("1 in 6" operation).

In practice, variation of waveform amplitude with droplet firing regime would require complex—and thus expensive—control electronics. The alternative solution of a constant waveform amplitude, whilst simpler and cheaper to implement, would give rise to variations in droplet ejection velocity and consequential droplet placement errors as discussed above.

According to a second aspect, the present invention consists in a method of operating an inkjet printhead for printing on a substrate, the printhead having an array of channels; a series of nozzles which communicate respectively with said channels for ejection of droplets therefrom; connection means for connecting the channels with a source of ink; and electrically actuable means associated with each channel and actuable a plurality of times in accordance with print tone data, thereby to eject a corresponding number of droplets to form a printed dot of appropriate tone on the substrate; the method comprising the steps of:

applying a plurality of electrical signals to the electrically actuable means associated with a channel in accordance with the print tone data, each electrical signal being held at a given non-zero level for a period, the duration of the period being chosen such that the velocity of the corresponding ejected droplet is substantially independent of (a) whether or not channels in the vicinity of said selected channel are similarly actuated to effect drop ejection simultaneously with drop ejection from said selected channel, and (b) the number of droplets to be ejected in accordance with the print tone data.

This second aspect of the invention results from the discovery that there are values of contraction period duration (DR) at which the droplet ejection velocity remains substantially constant regardless of the droplet firing regime. Operation in such ranges allows waveforms of constant amplitude to be used regardless of operating regime and therefore without the risk of droplet placement errors.

Preferred embodiments of this second aspect of the invention are set out in the dependent claims and description. The invention also comprises droplet deposition apparatus and drive circuit means adapted to operate according to these claims.

In the case of FIG. 6, for example, such constant behaviour occurs in the approximate ranges 1.8 $\mu$s$\leqq$DR$\leqq$2.2 $\mu$s (corresponding voltage waveform amplitude approximately 31.5 volts), with particularly close agreement between velocities being achieved at around 2.2 $\mu$s, and in the range 3.0 $\mu$s$\leqq$DR $\leqq$3.6 $\mu$s (corresponding voltage waveform amplitude in the range 34–39 volts), particularly 3.4 $\mu$s. Expressed in terms of half period of oscillation, L/c, these ranges are approximately 0.8 L/c $\leqq$DR$\leqq$1.0 L/c, particularly 1 L/c, and 1.4 L/c$\leqq$DR$\leqq$1.6 L/c, particularly 1.5 L/c. Operation in the lower rather than the higher range gives a lower overall waveform duration which in turn allows a higher waveform repetition frequency. The lower operating voltage for a given droplet speed in the 1.8 $\mu$s$\leqq$DR$\leqq$2.2 $\mu$s range also gives rise to correspondingly lower heat generation in the piezoelectric material of the printhead actuator walls. For these reasons, operation in the lower range is to be preferred.

It should be appreciated that printhead characteristics obtained for a constant droplet ejection velocity (U), as shown in FIG. 6, will include consistent fluid dynamic effects such as nozzle and ink inlet impedance which are themselves known, for example, from WO92/12014 incorporated herein by reference. The characteristics will incorporate viscosity variations, however, brought about by a variation in heating of the ink by the piezoelectric material of the printhead with variation in waveform amplitude (V). Piezoelectric heating of ink in a printhead is explained in WO97/35167, incorporated herein by reference, and consequently will not be discussed in further detail here.

Conversely, printhead characteristics of the kind shown in FIGS. 2,4 and obtained for a constant waveform amplitude (V) will include consistent heating effects at the expense of varying fluid dynamic effects. It will be appreciated, however, that at those operating conditions according to the present invention at which waveform amplitude and droplet ejection velocity remain constant regardless of operating regime, fluid dynamic and piezoelectric heating effects will also remain constant. Consequently either type of characteristic is suitable in determining operating conditions according to the present invention.

FIG. 7 illustrates the actuating waveform used in obtaining the characteristics of FIG. 6, with actuating voltage magnitude being indicated on the ordinate and normalised time on the abscissa. At "C" is indicated the channel contraction period, the duration (DR) of which is varied to obtain the characteristics of FIG. 6. There follows immediately a channel expansion period "X" of duration of 2 DR, followed by a period "D" of duration 0.5 DR in which the channel dwells in a condition in which it is neither contracted or expanded. Following the dwell period, the waveform can be repeated as appropriate to eject further droplets. Such a waveform has been found to be particularly effective in ejecting multiple droplets to form a single, variable-size, dot on a substrate without simultaneously causing the ejection of unwanted droplets (so called "accidentais") from neighbouring channels.

FIG. 6 et seq. were obtained using the described waveform in a printhead having a period of longitudinal oscillation of pressure waves in the channel (2 L/c) of approximately 4.4 μs, a nozzle outlet diameter of 25 μm, and a hydrocarbon ink of the kind disclosed in WO96/24642. Other parameters were typical, for example as disclosed in EP 0609080, EP 0611154, EP 0611655 and EP 0612623.

As explained above, for a given printhead design operating at a given peak-to-peak actuating voltage, it is possible to empirically determine advantageous operation points at which the velocity of an droplet ejected from a channel remains independent both of the number of droplets to be ejected from that channel to form a single printed dot on the substrate and of whether or not neighbouring channels are also actuated to effect droplet ejection.

There remains, however, the potential problem outlined in WO97/35167 of a variation in ink viscosity—and a resulting variation in droplet ejection velocity with the frequency at which droplet ejection takes place. In the case of a printhead utilising chambers the volume of which is variable by a piezoelectric actuating mechanism, for example, such viscosity variation is attributable to a variation in ink temperature which in turn is due to a variation with operating frequency in the amount of heat transferred to the ink from the piezoelectric material of the actuating mechanism for each chamber.

FIG. 8 shows such a variation in droplet ejection velocity (U) with peak-to-peak amplitude (V) for the printhead described above when operated according to the following droplet ejection regimes: (a) single droplet (1 dpd), low (1 dc) frequency operation; (b) single droplet (1 dpd), high (104 dc) frequency operation; (c) seven droplet (7 dpd), low (1 dc) frequency operation; (d) seven droplet (7 dpd), high (104 dc) frequency) operation, whereby 1 dc ("drop count") corresponds to a dot printing frequency of 60 Hz—a dot being formed by the ejection from a channel of one or more droplets in response to the application of one or more actuating waveforms—and 104 dc corresponds to a dot printing frequency of 6.2 kHz. In the particular example, actuation was by the waveform of FIG. 7 with the advantageous DR value of 2.2 μs as determined from FIG. 6.

Comparing characteristics (a) and (b), it will be seen that, at any given value of peak-to-peak waveform amplitude (V), the droplet ejection velocity (U) from a channel firing at 6.2 kHz is between 3 and 5 m/s (on average 4 m/s) greater than the value of U for a channel firing at 60 Hz. Furthermore, the value (Vmin) of waveform amplitude below which droplet ejection no longer takes place is lower (29V giving 4 m/s) at the higher firing frequency that at the lower firing frequency (30V giving 2 m/s). There is also a corresponding reduction in the value, Vmax, of waveform amplitude above which the printhead is no longer able to eject droplets due, amongst other things, to the known problem of air-sucking.

Similar patterns are evident in the seven droplet per dot characteristics (c) and (d), with a difference in U at a given V of around 7 m/s and a Vmin value of approximately 2 m/s at 30V at 60 Hz compared with a value of 5 m/s at 25V when firing at 6.2 kHz.

It will also be noted that the range of waveform amplitude values (V) over which droplet ejection takes place decreases from 30 or more volts in the 1 dpd/1 dc and 1 dpd/104 dc regimes (a) and (b) to only 6 volts in the 7 dpd/104 dc regime (d). In particular, the maximum values of amplitude at which droplet ejection takes place (Vmax) reduce with regime from 50V (giving U=21 m/s) in regime (a) to 31V (giving U=10m/s) in regime (d). Conversely, performance at lower voltages increases with drops per dot/drop count, with an amplitude of only 25 volts being required to effect droplet ejection (at 4.5 m/s) in regime (d) as against the 30 volts needed to eject a droplet (at 2.5 m/s) in regimes (a) and (b). This behaviour is believed to be attributable to a reduction in ink viscosity brought about by increased heat generation in the piezoelectric actuator when operated to eject higher numbers of drops per dot.

As already mentioned, a droplet ejection speed of at least 5 m/s is necessary for effective image formation. In the case of a printhead operating in accordance with FIG. 8, it will be noted that there is no common value of V at which droplet ejection in excess of 5 m/s can be obtained for all operating regimes. Such a printhead is said to have no operating window.

The solution to the above problem is also described in the aforementioned WO97/35167 and entails supplying the actuating mechanism of each chamber with one of several voltage waveforms depending on whether droplet ejection is required. Where incoming print data dictates that droplet ejection is to take place, a waveform according to the present invention—for example having an advantageous DR value of the kind discussed with regard to FIGS. 6 and 7—can be applied. Alternatively, where no droplet ejection is to take place, there is applied a waveform that is insufficient to effect droplet ejection yet sufficient to generate an amount of heat in the piezoelectric material of the actuating mechanism to keep the ink in the chamber at the same temperature (and thus viscosity) as its droplet-ejecting neighbours.

Such a non-ejecting waveform shape is known from the aforementioned WO97/35167, repeated in FIG. 9 for convenience. It is particularly suited to printheads in which actuator walls are defined between ink channels each having a channel electrode, successive channels in the printhead being alternately allocated to one of three groups which themselves are enabled one after another for droplet ejection. Such operation is well-known—e.g. from WO95/25011—and consequently will not be discussed in greater detail.

By offsetting by an amount "P" the voltage pulse 60 applied to a channel belonging to an enabled channel group relative to voltage pulses 70 applied to neighbouring channels belonging to non-enabled groups, it is possible to generate across the actuator walls bounding that enabled channel an actuation waveform, shown at 80 in FIG. 9, that has the same value of peak-to-peak amplitude (V) as a corresponding droplet-ejecting waveform but a duration of contraction and expansion periods reduced to a level where heat generation—but no droplet ejection—takes place. Alternative non-ejecting waveforms in which amplitude rather than duration is reduced to a non-ejecting level may equally well be used. Examples are disclosed in WO97/35167.

FIG. 10*a* is an example of the ejecting and non-ejecting actuation waveforms that might be applied to three neighbouring channels belonging to three successively-enabled channel groups A,B and C in the case where the incoming print data specifies 100%, 0% and 42% (3/7) print density respectively.

In the period 100 of enablement of the channel belonging to group A, seven droplet ejecting waveforms 110 of the kind shown in FIG. 7 are applied in immediate succession, thereby to eject seven droplets to form a single, maximum-size dot on the substrate.

In the subsequent period 120 of enablement of the channel belonging to group B, seven non-ejecting waveforms 130 of the kind shown in FIG. 7 are applied in immediate succession. No droplets are ejected—giving the desired 0% print density—but sufficient heat is generated in the printhead actuator walls and transferred to the ink to maintain the ink at substantially the same temperature as if the channel had been actuated to eject seven drops.

During the period of enablement 140 of the channel belonging to group C, three ejecting waveforms 150 followed by four non-ejecting waveforms 160 are applied, thereby to eject three out of a possible seven droplets to form a 42% sized printed dot yet maintain the ink in that channel at temperature corresponding to seven drop ejection.

Cycles A, B and C are subsequently repeated, droplets being ejected in accordance with print data.

FIG. 10*b* illustrates the corresponding voltage waveforms applied to the channel electrodes of the three neighbouring channels to generate the actuating waveforms shown in FIG. 10*a*.

As explained in WO97/35167, the necessary level of heat generation by a non-ejecting waveform may be established by a simple process of trial and error. FIG. 11 shows the effect of varying the offset, P, referred to above for a channel actuated at a frequency of 6.2 kHz (the aforementioned "104 dc" operation), the first cycle comprising a train of seven droplet-ejecting waveforms—as per cycle A in FIG. 10*a*—and the following 103 cycles each comprising a train of seven non-ejecting waveforms as per cycle B of FIG. 10*a*. P values for the non-ejecting waveforms are given as a fraction of the contraction period (DR) of the equivalent, droplet-ejecting waveform. There is also shown a characteristic for a "7 dpd/104 dc" operation in which the channel is repeatedly actuated at a frequency of 6.2 kHz with a train of seven droplet-ejecting waveforms.

It will be seen that the 7 dpd/1dc characteristics form a series in which the ejection velocity U at a given actuating voltage amplitude V increases with P. The 7 dpd/104 dc characteristic does not form part of this series, but is almost coincident with the characteristic for 7 dpd/1 dc, P=0.35, i.e. there is little difference between the velocity of droplets ejected by the two waveforms. This indicates that a non-ejecting waveform having P=0.35 gives a degree of ink heating which most closely matches that generated during droplet ejection, taking account of the heat that is taken out of the ink channel by the ink droplet itself.

Whilst the value of P=0.35 is believed to apply to all printheads having similar thermal conduction properties to those of the general printhead construction outlined above, it will be understood that other printhead designs may well have different thermal conduction properties. Similar considerations apply to the ink used in the printhead. In such cases, different values of P will be necessary, to be determined by an iterative process such as outlined above. Reference to WO97/35167 is made in this regard.

The higher velocities of the characteristics having P greater than 0.35 (i.e 20P=0.4 and greater) correspond to an amount of heat being given to the ink by a non-ejecting waveform that actually exceeds that generated during normal droplet ejection.

FIG. 12 illustrates the performance of the printhead used to obtain FIG. 8 when operated using a non-ejecting waveform having P=0.35 as determined in the simple trial and error method outlined above. It is clear from the figure that droplet ejection velocity U is independent of whether one or seven droplets are ejected to form a printed dot on a substrate and/or whether the train of one or seven droplets is repeated at a frequency of 60 Hz or 6.2 kHz. Droplet ejection regardless of regime will be seen to take place for voltage waveform amplitudes in the approximate range 26–30 volts giving rise to the corresponding ejection velocity range of approximately 4–10 m/s.

FIG. 13 is a detailed view of FIG. 12 showing the operating window W of approximately 3.6V within which droplet ejection velocity U (in the approximate range 5–9.5 m/s) remains greater than or equal to 5 m/s and substantially independent of the number of droplets ejected in a train to form a printed dot on the substrate and of the frequency at which such a train is repeated. This is in contrast to the operation described above with reference to FIG. 8 and having no operating window. Further, as mentioned above, the choice of droplet ejection waveform in accordance with the invention, ensures that the droplet ejection velocity also remains substantially independent of whether or not channels in the vicinity of the firing channel are similarly actuated to effect droplet ejection.

The use of non-ejecting pulses as described above also makes the system as a whole more energetic with the result that, for ejection regimes (a)–(c) at least, droplet ejection begins at a lower value of amplitude (Vmin) than when operated without such pulses as per FIG. 8.

Whilst specific reference has been made to apparatus as described in WO95/25011, the present invention may be applicable to a wide range of ink jet apparatus, particularly apparatus in which a channel dividing side wall is displaceable in either of two opposing directions. Simlarly, the term ink jet may include the ejection of substances other than ink to form an image on a substrate.

What is claimed is:

1. A method of operating an inkjet printhead for printing on a substrate, the printhead having an array of channels;

a series of nozzles which communicate respectively with said channels for ejection of droplets therefrom;

connection means for connecting the channels with a source of ink;

and electrically actuable means associated with each channel and actuable a plurality of times in accordance with print tone data, thereby to eject a corresponding number of droplets to form a printed dot of appropriate tone on the substrate;

the method comprising the steps of applying a one or a plurality of electrical signals to the electrically actuable means associated with a channel in accordance with the print tone data, each signal having a duration chosen such that the velocity of the corresponding ejected droplet is substantially independent of (a) whether or not channels in the vicinity of said selected channel are similarly actuated to effect drop ejection simultaneously with drop ejection from said selected channel, and (b) the number of droplets which are ejected in accordance with the print tone data.

2. Method according to claim 1, wherein successive channels of the array are regularly assigned to groups such that a channel belonging to any one group is bounded on either side by channels belonging to at least one other group, the method comprising the steps of:

sequentially enabling the groups of channels for actuation in successive periods;

choosing the duration of each signal such that the velocity of the corresponding ejected droplet is substantially independent of (a) whether or not those channels belonging to the same group as the selected channel and which are located nearest in the array to said selected channel are similarly actuated to effect droplet ejection simultaneously with drop ejection from the selected channel, and (b) the number of droplets which are ejected in accordance with the print tone data.

3. Method according to claim 1, wherein the ratio of the duration of each signal to the half period of oscillation of longitudinal pressure waves in said channel lies in the ranges 1.5—1.9 or 3.5—3.8 or in the vicinity of the values 5.5 and 7.5.

4. Method according to claim 1, comprising the step of adapting the electrically actuable means to vary the volume of the channel, thereby to effect droplet ejection therefrom.

5. Method according to claim 4, wherein said electrical signal effects an expansion of the channel followed by a contraction of the channel.

6. Method according to claim 5, wherein the channel is held in expanded and contracted states for equal periods of time.

7. Method according to claim 1, wherein said plurality of electrical signals are applied in immediate succession.

8. Method according to claim 1, wherein successive electrical signals are separated in time by a dwell period.

9. Method according to claim 1, wherein a number of further electrical signals is applied to the electrically actuable means, each further signal causing a change in temperature of the droplet fluid in the chamber without causing droplet ejection, said change in temperature being substantially equal to that caused by the application of an electrical signal to effect ejection of a droplet.

10. Method according to claim 9, wherein droplets to form a printed dot on the substrate are ejected in a droplet ejection period, the sum of the number of electrical signals and the number of further electrical signals applied being constant for successive droplet ejection periods.

11. Method according to claim 9, wherein said further electrical signal is held at a given non-zero level for a further period.

12. Method according to claim 11, wherein the ratio of the duration of said further period to the duration of said period at which said electrical signal is held at a given non-zero level is less than one.

13. Method according to claim 12, wherein the ratio is less than 0.4.

14. Method according to claim 13, wherein the ratio is approximately 0.35.

15. Method according to claim 11, wherein said further electrical signal is held at a first given non-zero level for a first further period and thereafter at a second given non-zero level for a second further period, said first and second given non-zero levels being of opposite sign.

16. Method according to claim 1, wherein said first and second further periods are of equal duration.

17. Method according to claim 1, wherein the velocity of the ejected droplet is at least 5 m/s.

18. Method according to claim 17, wherein the velocity of the ejected droplet is at least 7 m/s.

19. Method according to claim 1, wherein the half period of oscillation of longitudinal pressure waves in the ink in the channel has a value not exceeding 5 $\mu$s.

20. Method according to claim 19, wherein the half period of oscillation of longitudinal pressure in the ink in the channel has a value not exceeding 2.5 $\mu$s.

21. An inkjet printhead for printing on a substrate the printhead having:

an array of channels;

a series of nozzles which communicate respectively with said channels for ejection of droplets therefrom;

means for connecting the channels with a source of ink;

electrically actuable means associated with each channel for ejecting droplets in response to electrical signals;

and a drive circuit for applying the electrical signals one or a plurality of times in accordance with print tone data, thereby to eject a corresponding number of droplets which merge to form a printed dot of appropriate tone on the substrate;

the drive circuit being configured to operate in accordance with claim 1.

22. A drive circuit for an inkjet printhead for printing on a substrate; the printhead having;

an array of channels;

a series of nozzles which communicate respectively with said channels for ejection of droplets therefrom;

means for connecting the channels with a source of ink;

electrically actuable means associated with each channel for ejecting droplets in response to electrical signals;

and a drive circuit for applying the electrical signals one or a plurality of times in accordance with print tone data, thereby to eject a corresponding number of droplets to form a printed dot of appropriate tone on the substrate;

the drive circuit being configured to operate in accordance with claim 1.

23. A method of operating an inkjet printhead for printing on a substrate, the printhead having an array of channels;

a series of nozzles which communicate respectively with said channels for ejection of droplets therefrom;

connection means for connecting the channels with a source of ink;

and electrically actuable means associated with each channel and actuable a plurality of times in accordance with print tone data, thereby to eject a corresponding number of droplets which merge to form a printed dot of appropriate tone on the substrate;

the method comprising the steps of applying a plurality of electrical signals to the electrically actuable means associated with a channel in accordance with the print tone data, each electrical signal being held at a given non-zero level for a period having a duration chosen such that the velocity of the corresponding ejected droplet is substantially independent of (a) whether or not channels in the vicinity of said selected channel are similarly actuated to effect drop ejection simultaneously with drop ejection from said selected channel, and (b) the number of droplets which are ejected in accordance with the print tone data.

24. Method according to claim 23, wherein successive channels of the array are regularly assigned to groups such that a channel belonging to any one group is bounded on either side by channels belonging to at least one other group, the method comprising the steps of:

sequentially enabling the groups of channels for actuation in successive periods;

holding each electrical signal at a given non-zero level for a period, the duration of the period being chosen such that the velocity of the corresponding ejected droplet is substantially independent of (a) whether or not those channels belonging to the same group as the selected channel and which are located nearest in the array to said selected channel are similarly actuated to effect droplet ejection simultaneously with drop ejection from the selected channel, and (b) the number or droplets which are ejected in accordance with the print tone data.

25. Method according to claim 23, wherein the ratio of the duration of the period for which each electrical signal is held at a given non-zero level to the half period of oscillation of longitudinal pressure waves in said channel lies in the ranges 0.8 to 1.0 or 1.4 to 1.6.

26. Method according to claim 23, and wherein the electrical signal being held at said given non-zero level effects an increase in the volume of the respective channel.

27. Method according to claim 26, wherein said electrical signal effects an expansion of the channel followed by a contraction of the channel.

28. Method according to claim 27, wherein the channel is held in expanded and contracted states for equal periods of time.

* * * * *